US007138960B2

(12) United States Patent
Carroll et al.

(10) Patent No.: US 7,138,960 B2
(45) Date of Patent: Nov. 21, 2006

(54) DEPLOYABLE ELECTROMAGNETIC CONCENTRATOR

(75) Inventors: Joseph P. Carroll, Moorpark, CA (US); James A. McClanahan, Woodland Hills, CA (US)

(73) Assignee: United Technologies Corporation, Hartford, CT (US)

( * ) Notice: Subject to any disclaimer, the term of this patent is extended or adjusted under 35 U.S.C. 154(b) by 86 days.

(21) Appl. No.: 10/929,070

(22) Filed: Aug. 27, 2004

(65) Prior Publication Data

US 2006/0044213 A1 Mar. 2, 2006

(51) Int. Cl.
*H01Q 3/02* (2006.01)

(52) U.S. Cl. ..... 343/882; 343/766; 343/915

(58) Field of Classification Search ..... 343/912, 343/915, 916, 880, 882, 781 P, 781 R, DIG. 2, 343/757, 765, 766
See application file for complete search history.

(56) References Cited

U.S. PATENT DOCUMENTS 4,562,441 A * 12/1985 Beretta et al. ..... 343/781 P
4,781,018 A 11/1988 Shoji
4,811,034 A * 3/1989 Kaminskas ..... 343/915
5,138,832 A 8/1992 Pande
5,966,104 A * 10/1999 Massey et al. ..... 343/915
6,229,501 B1 * 5/2001 Roth et al. ..... 343/915
6,441,801 B1 8/2002 Knight et al.
6,448,940 B1 * 9/2002 Chiang ..... 343/882
6,557,804 B1 5/2003 Carroll

* cited by examiner

*Primary Examiner*—Hoanganh Le
(74) *Attorney, Agent, or Firm*—Kinney & Lange, P.A.

(57) ABSTRACT

A deployable electromagnetic concentrator comprises a facet stem hub assembly having at least one rotatable segment and a plurality of facets stems coupled thereto. At least one of the facet stems is coupled to at least one of the rotatable segments. The concentrator further comprises a plurality of facet stems, each being coupled to a different one of the rotatable segments for rotating the plurality of facets from a substantially overlapping configuration to a substantially non-overlapping configuration.

34 Claims, 6 Drawing Sheets

DEPLOYABLE ELECTROMAGNETIC CONCENTRATOR

STATEMENT REGARDING FEDERALLY SPONSORED RESEARCH

This invention was made with Government support under Contract No. F29601-03-C-0147 awarded by the United States Air Force. The Government has certain rights in this invention.

FIELD OF THE INVENTION

The present invention relates generally to electromagnetic concentrators, and more specifically to a deployable electromagnetic concentrator particularly suited for use aboard a spacecraft.

BACKGROUND OF THE INVENTION

Concentrators that collect and focus electromagnetic radiation are well-known in many technological fields. Radio frequency concentrators, for example, may be employed for telecommunications purposes. For space applications, solar concentrators capable of collecting and focusing sunlight may be employed in conjunction with solar tracking systems to form solar concentration and tracking systems (CATS) that may be used in conjunction with thermal propulsion or solar dynamic power systems. These systems typically employ solar concentrators to focus sunlight and heat a fluid. In thermal propulsion systems, for example, the heated fluid is used as a propellant to produce thrust when released from a rocket nozzle. In solar dynamic power systems, the heated fluid is used to drive a generator or alternator to produce electricity.

There are several kinds of solar concentrators of the types discussed above for use in space applications, such as foldable and inflatable solar concentrators. Foldable solar concentrators that comprise a plurality of rigid panels provide good optical performance, but their launch vehicle stowage options are relatively inefficient. Inflatable solar concentrators comprising expandable reflective balloons stow more efficiently while deflated, but provide relatively poor optical performance when inflated due to folds incurred during stowage. Additionally, inflatable solar concentrators are relatively vulnerable to damage (e.g. punctures caused by space debris) when inflated. Although this vulnerability may be partially mitigated by utilizing an inflation and deployment subsystem employing make-up gas, such systems are relatively complex.

It should thus be appreciated that it would be desirable to provide an electromagnetic concentrator that not only performs well when deployed, but also stows efficiently in a launch vehicle.

BRIEF SUMMARY OF THE INVENTION

According to a broad aspect of the invention there is provided a deployable electromagnetic concentrator comprising a facet stem hub assembly having at least one rotatable segment and a plurality of facet stems coupled thereto. At least one of the plurality of facet stems is coupled to at least one of the rotatable segments. The concentrator further comprises a plurality of facets, each one being coupled to a different one of the plurality of facet stems for rotating the plurality of facets from a substantially overlapping configuration to a substantially non-overlapping configuration.

According to a further aspect of the invention there is provided an electromagnetic concentrator for use on a spacecraft having a radiation collector coupled thereto and having a deployment boom having a proximal end coupled to the spacecraft and having a distal end. The electromagnetic concentrator comprises a facet stem hub assembly coupled to the distal end of the deployment boom and has a plurality of facet stems coupled thereto. The facet stem hub assembly has a plurality of rotatable segments to which at least one of the plurality of rotatable segments is coupled. The concentrator further comprises a plurality of facets, each one being coupled to a different one of the plurality of facet stems, and is configured to rotate from an overlapped configuration wherein the plurality of facets is substantially stacked to a non-overlapped configuration wherein the plurality of facets is angularly dispersed around the facet stem hub assembly and wherein the plurality of facets is configured to concentrate radiation into the radiation collector.

According to a still further aspect of the invention there is provided a spacecraft, comprising a payload and a deployment boom. The deployment boom comprises a proximal rotatable joint coupled to the payload, a first elongated segment having a distal end and a proximal end that is coupled to the proximal rotatable joint, an intermediate rotatable joint that is coupled to the first elongated segment's distal end, a second elongated segment having a distal end and a proximal end that is coupled to the intermediate rotatable joint, and a distal rotatable joint coupled to the second elongated segment's distal end. The spacecraft further comprises an electromagnetic collector coupled to the payload, and an electromagnetic concentrator. The concentrator comprises a facet stem hub assembly that has a plurality of rotatable segments disposed substantially thereround and is coupled to the distal end of the second elongated segment, and a plurality of telescopic facet stems coupled to the facet stem hub assembly. At least one of the plurality of telescopic facet stems is coupled to at least one of the plurality rotatable segments. The concentrator further comprises a plurality of facets each one coupled to a different one of the plurality of telescopic facet stems. The concentrator is configured to rotate from an overlapped configuration, wherein the plurality of facets is substantially stacked and wherein the first segment and the second segment of the deployment boom are substantially parallel and adjacent, to a non-overlapped configuration, wherein the plurality of facets is angularly dispersed around the facet stem hub assembly and configured to substantially concentrate radiation into the radiation collector.

According to a still further aspect of the invention there is provided a method for deploying an electromagnetic concentrator in an overlapping configuration, the electromagnetic concentrator being coupled by way of a deployment boom to a spacecraft having an electromagnetic collector and comprising a facet stem hub assembly having N facet stems coupled thereto, the facet stem hub assembly comprising multiple rotatable segments each one being coupled to no more than N-1 of the N facets stems, N facet stems each further being coupled to a different one of a plurality of stacked facets, the method comprising extending the deployment boom from the spacecraft, and angularly dispersing the plurality of facets around the facet stem hub assembly by rotating at least one of the rotatable segments.

BRIEF DESCRIPTION OF THE DRAWINGS

The present invention will hereinafter be described in conjunction with the following figures, wherein like reference numerals denote like elements, and.

DETAILED DESCRIPTION OF THE INVENTION

The following detailed description of the invention is merely exemplary in nature and is not intended to limit the scope, applicability, or configuration of the invention in any way. Rather, the following description provides a convenient illustration for implementing the exemplary embodiment of the invention. Various changes to the described embodiment may be made in the function and arrangement of the elements described herein without departing from the scope of the invention.

Figure 1:
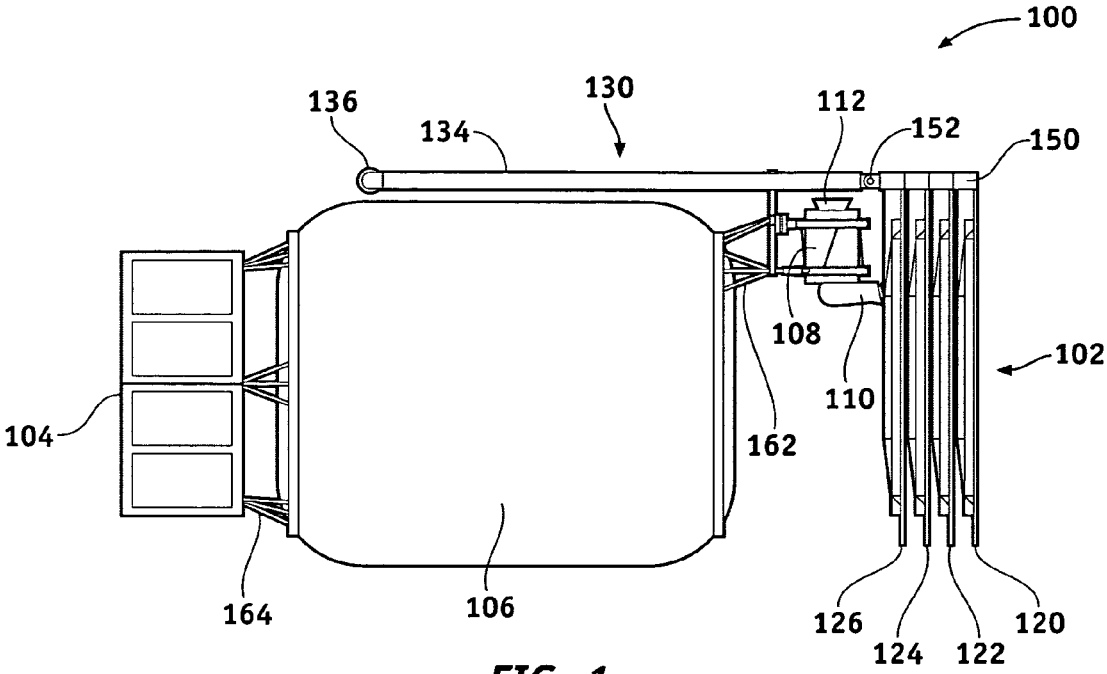
FIG. 1 is a side view of a spacecraft including an electromagnetic concentrator in an undeployed (stacked or stowed) configuration in accordance with the present invention.
Figure 2:
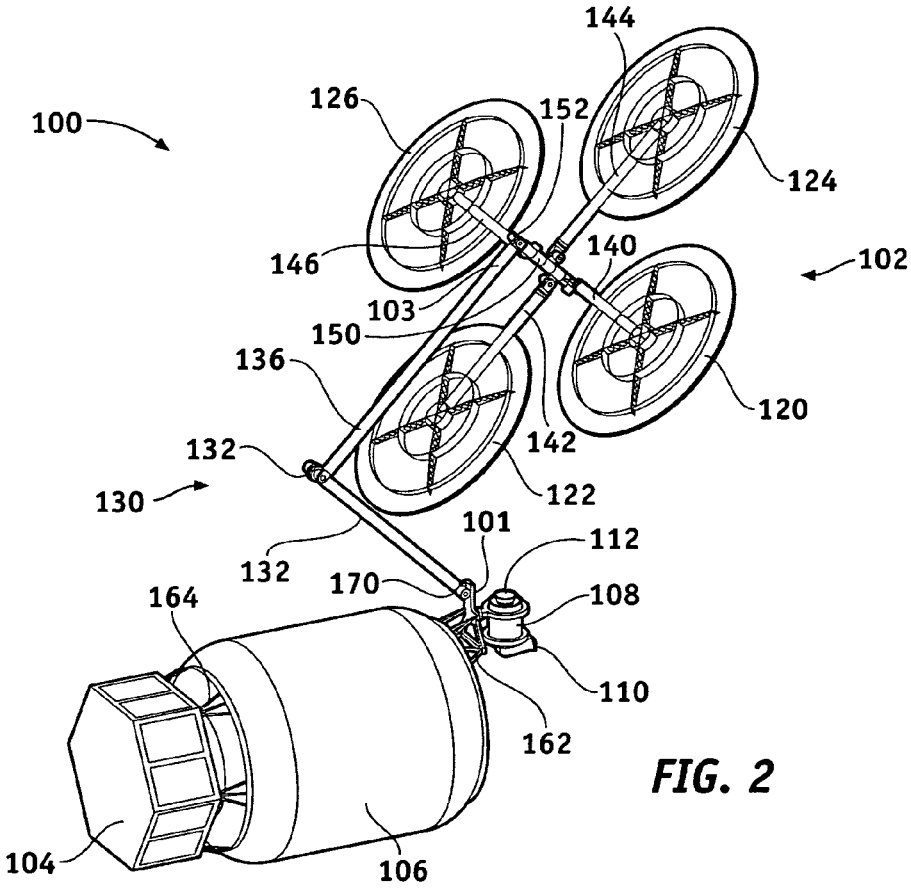
FIG. 2 is an isometric view of the spacecraft shown in FIG. 1 with the electromagnetic concentrator in a deployed (angularly dispersed or unstowed) configuration.

FIGS. 1 and 2 are respective side and isometric views of a spacecraft 100 including a deployable electromagnetic concentrator 102 in accordance with the present invention. FIG. 1 depicts electromagnetic concentrator 102 in an overlapping facet configuration wherein the facet array is substantially stacked (i.e. in an undeployed configuration). This configuration facilitates stowage in a stowage compartment, such as that provided within a launch vehicle's fairing. In contrast, FIG. 2 depicts deployable electromagnetic concentrator 102 in a non-overlapping facet configuration wherein each facet is angularly dispersed around a facet stem hub assembly 150 in a four-leaf-clover-type pattern (i.e. a deployed configuration). Before discussing the manner in which electromagnetic concentrator 102 transitions from the stowed configuration (FIG. 1) to the deployed configuration (FIG. 2), the structure of the exemplary embodiment will be described.

Spacecraft 100 comprises payload 104 that is coupled by way of truss 164 to propellant tank 106. Propellant tank 106 is similarly coupled by way of truss 162 to a solar thermal engine 108 that comprises a rocket nozzle 110 and a collector or secondary concentrator 112. A deployment boom 130 (e.g. made of a composite such as carbon matrix) comprising segments 132 and 134 is coupled to truss 162 at its proximal end 101 and to an electromagnetic radiation concentrator 102 at its distal end 103. Electromagnetic concentrator 102 comprises an array of reflective facets coupled to face stem hub assembly 150 via a plurality of facet stems. The reflective facet array comprises a number N of reflective facets. In accordance with the exemplary embodiment, the reflective facet array may comprise four generally circular facets 120, 122, 124, and 126. The face of each facet comprises a reflective parabolic surface (e.g. a lightweight composite mirror) that may focus electromagnetic radiation (e.g. sunlight) at collector 112. Four telescopic facet stems 140, 142, 144, and 146 are affixed to the backs of facets 120, 122, 124, and 126, respectively, to couple each facet to facet stem hub assembly 150. Hub assembly 150 is, in turn, coupled to the distal end 103 of deployment boom 130.

Figure 3:
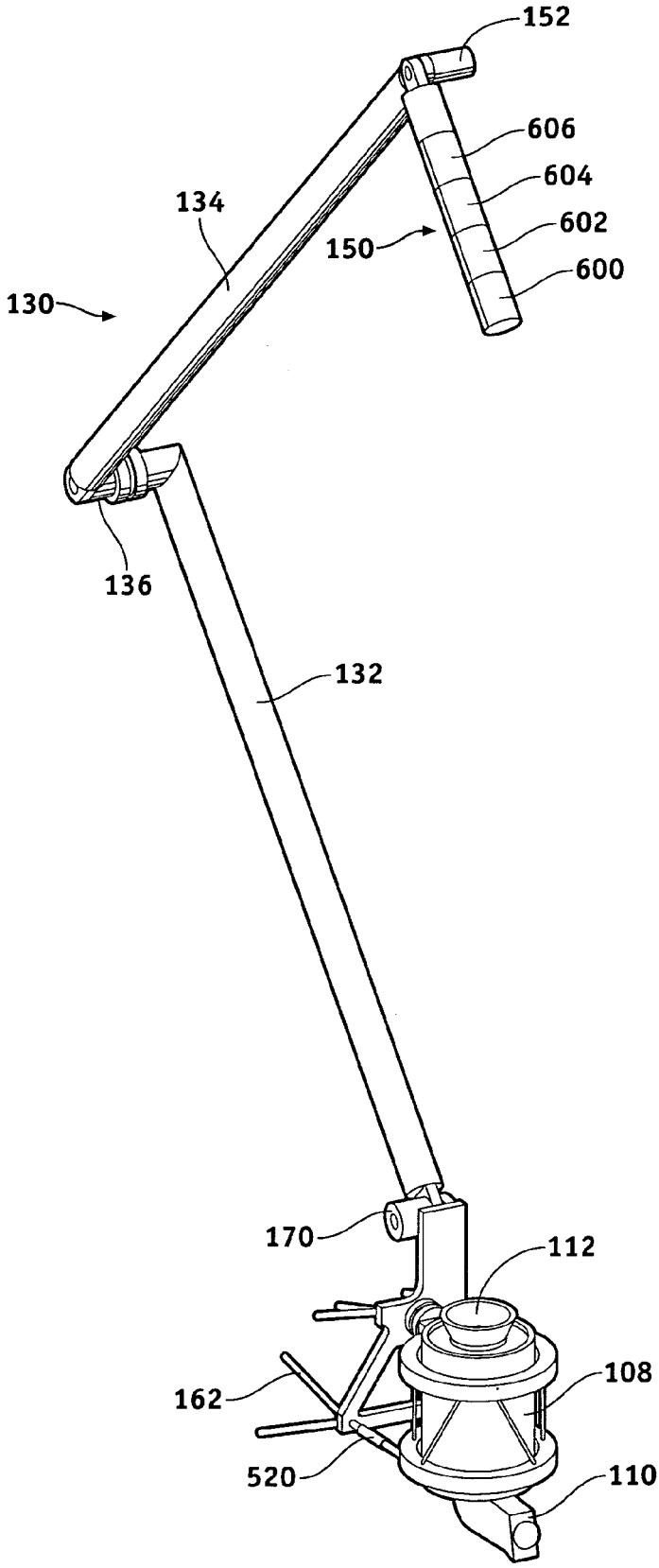
FIG. 3 is an isometric view of the solar thermal engine, deployment boom, and facet stem hub assembly of the concentrator depicted in FIGS. 1 and 2.

As illustrated in FIG. 3, deployment boom 130 may comprise first and second elongated, generally tubular segments: a proximal segment 132 and distal segment 134. Deployment boom 130 may further comprise first, second, and third motorized rotatable joints (e.g. spring-driven torsion motor joints): a proximal joint 170 that rotatably couples the proximal end of proximal segment 132 to truss 162, an intermediate joint 136 that rotatably couples the distal end of segment 132 to the proximal end of segment 134, and a distal joint 152 that rotatably couples the distal end of segment 134 to the proximal end of facet stem hub assembly 150.

Figure 4:
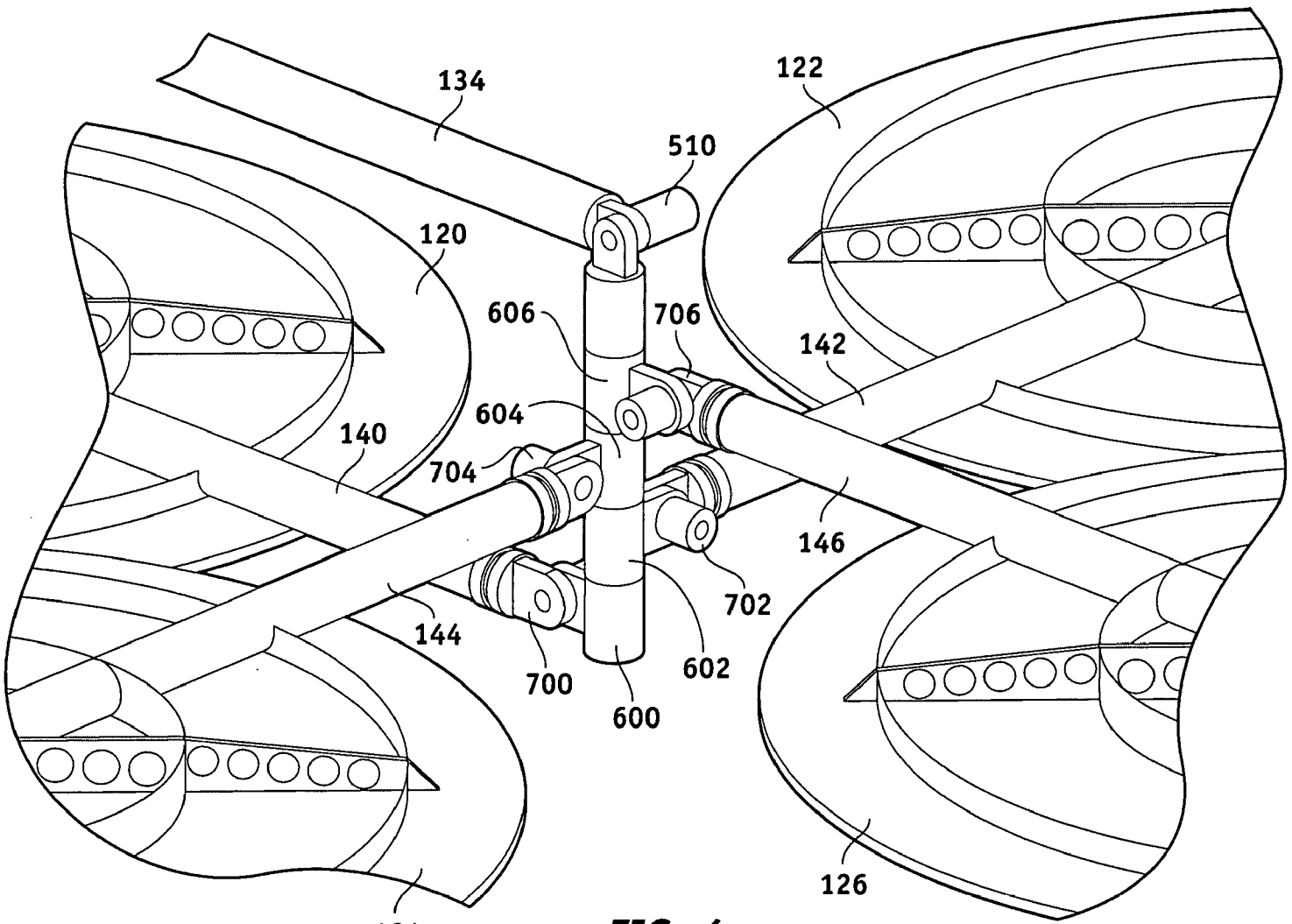
FIG. 4 is a more detailed isometric view the facet stem hub assembly and facet stems of the concentrator depicted in FIGS. 1–3.

As is also illustrated in FIG. 3, facet stem hub assembly 150 comprises a center post 600 having a number (i.e. N−1) rotatable segments or cuffs disposed substantially thereround. For example, center post 600 may comprise at least first, second, and third rotatable segments or cuffs 602, 604, and 606 respectively disposed thereround. The rotatable cuffs may each rotate relative to the center post and thereby rotate a corresponding number (i.e. N−1) of facets around the facet stem hub assembly. For example, cuffs 602, 604 and 606 may each rotate relative to center post 600 and thereby rotate respective facets 122, 124, and 126 around facet stem hub assembly 150 to angularly disperse the facets (e.g. position the facets so that each facet is separated from adjacent facets by substantially N460 360/N degrees) during deployment. As is illustrated in FIG. 4, rotatable cuffs 602, 604, and 606 are coupled to telescopic facet stems 142, 144, and 146, respectively, which are, in turn, coupled to facets 122, 124, and 126, respectively. Telescopic facet stem 140, and thus facet 120, may be fixedly coupled to center post 600 and therefore not configured to rotate around post assembly 150 as are the other facets; facet 120 does not need to so rotate to assume its position in the non-overlapping (i.e. deployed) configuration as will be more fully described below.

Telescopic facet stems 140, 142, 144, and 146 permit respective facets 120, 122, 124, and 126 to each be manipulated about two axes: (1) each facet stem may extend longitudinally (i.e. slide telescopically) so as to radially displace each facet with respect to stem hub assembly 150, and, (2) each facet stem may rotate about its longitudinal axis so as to swivel the attached facet relative to the rest of the facet array. Facet stems 140, 142, 144, and 146 are permitted to swivel by respective swivel motors 700, 702, 704, and 706 (e.g. stepper motors) shown in FIG. 4.

Figure 5A:
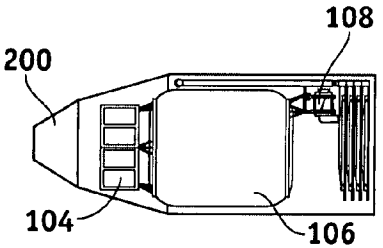
FIGS. 5A–5F illustrate an exemplary deployment sequence performed by a spacecraft having a concentrator of the type depicted in FIGS. 1–4.

FIGS. 5A–5F illustrate six stages of an exemplary deployment sequence of the inventive electromagnetic concentrator. FIG. 5A illustrates spacecraft 100 prior to launch. At this stage, electromagnetic concentrator 102 is in an overlapping facet (i.e. undeployed) configuration (also shown in FIG. 1) and stowed within a launch vehicle fairing 200, which protects concentrator 102 and spacecraft 100 from environmental stresses experienced during launch (e.g. extremely high temperatures). In the undeployed configuration, telescopic booms 140, 142, 144, and 146 may be retracted, deployment boom 130 may be folded in scissor-like fashion such that segments 132 and 134 are substantially adjacent and parallel, and distal segment 134 may be rotated to be collinear with hub assembly 150.

Figure 7:
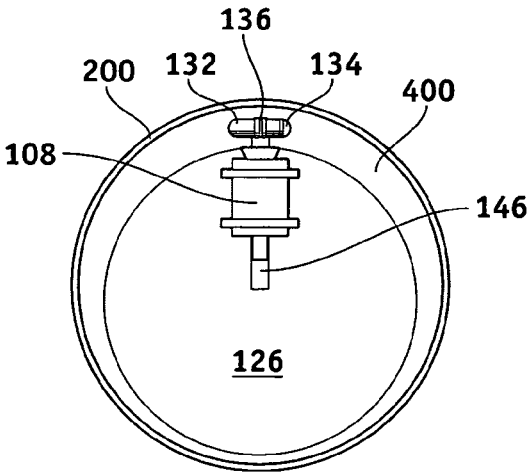
FIGS. 7 and 8 are cross-sectional views taken along lines 7—7 and 8—8, respectively, in FIG. 6.
Figure 8:
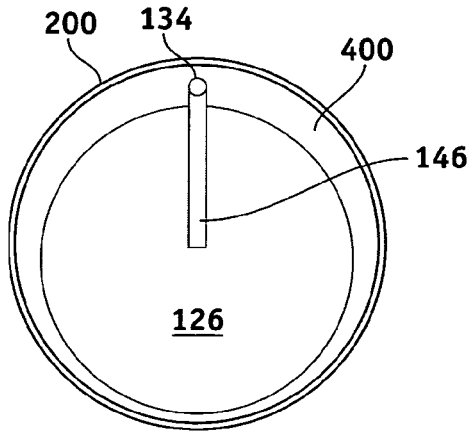

The inventive electromagnetic concentrator 102 allows any practical number of rigid facets to be efficiently stowed within the launch vehicle fairing. The stowage efficiency of the inventive electromagnetic concentrator may be more fully appreciated by referring to FIG. 6, which is a cutaway view illustrating thermal engine 108 and electromagnetic concentrator 102 in a stacked (i.e. undeployed) configuration and stowed within fairing 200. FIGS. 7 and 8 are cross-sectional views taken along lines 7—7 and 8—8, respectively. It should be appreciated that in FIGS. 6–8 payload 104 and propellant tank 106 are not shown for clarity.

Figure 6:
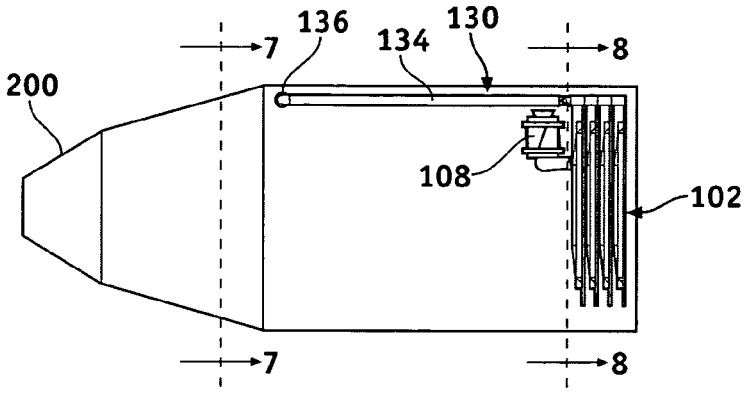
FIG. 6 is a side cutaway view of a thermal engine and electromagnetic concentrator of the type depicted in FIGS. 1–5 stowed within a launch vehicle fairing.

As can be seen in FIG. 6, telescopic facet stems 140, 142, 144, and 146 are retracted. The diameter of each facet is somewhat less than that of fairing 200 so that the fairing can accommodate deployment boom 130. Other than that, the use of stowage space 400 and facet diameter is maximized. Thus, the diameter and shape of the facets will be configured to substantially conform to the diameter and shape of the launch vehicle fairing to optimize stowage. Generally, the fairing shape will be substantially cylindrical, and the fairing diameter will range from about 2.0 to 7.0 meters. Correspondingly, facet shape will typically be circular and facet diameter will range from about 1.9 to 6.9 meters.

Figure 5B:
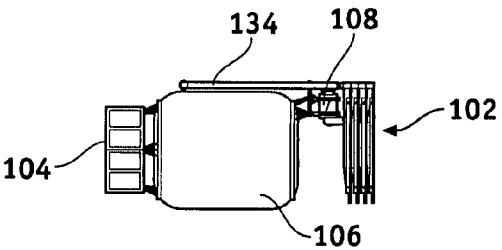
Figure 5C:
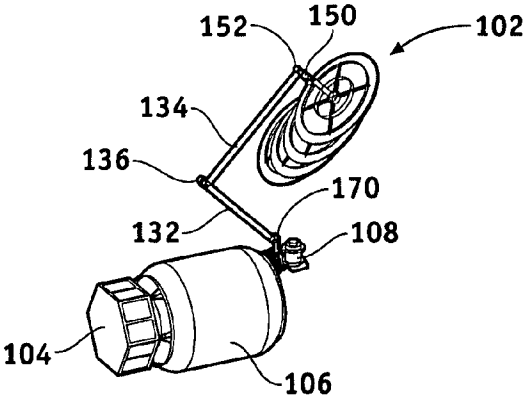

At some point after launch, fairing 200 may be jettisoned leaving payload 104, tank 106, and concentrator 102 in its undeployed configuration as illustrated in FIG. 5B. When unencumbered, concentrator 102 may deploy in the following manner. First, as illustrated in FIG. 5C, motorized rotatable joints 170, 136, and 152 rotate to move and extend deployment boom 130 away from tank 106. More specifically, proximal joint 170 may rotate segment 132 away from the body of tank 106, and intermediate joint 136 may rotate the distal end of segment 134 away from the proximal end of segment 132. In this manner, deployment boom 130 may position the reflective facet array relative to the rest of spacecraft 100.

Figure 5D:
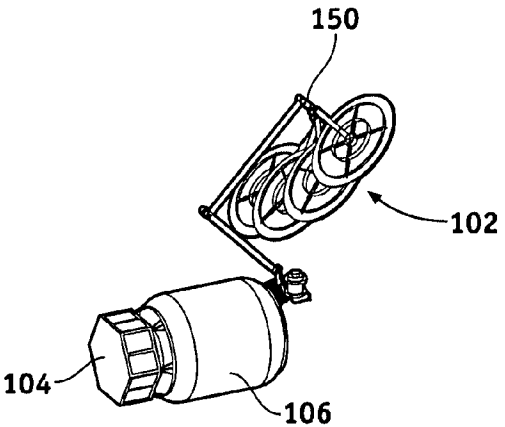
Figure 5E:
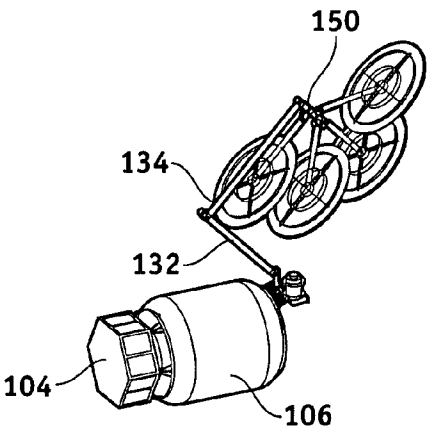
Figure 5F:
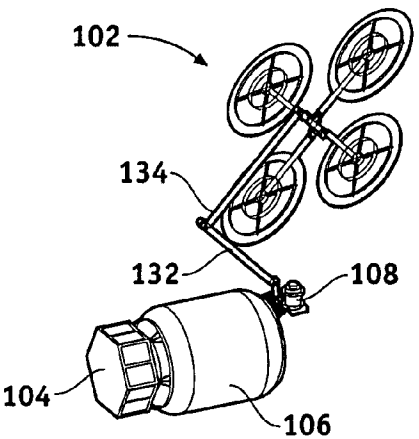
Figure 9:
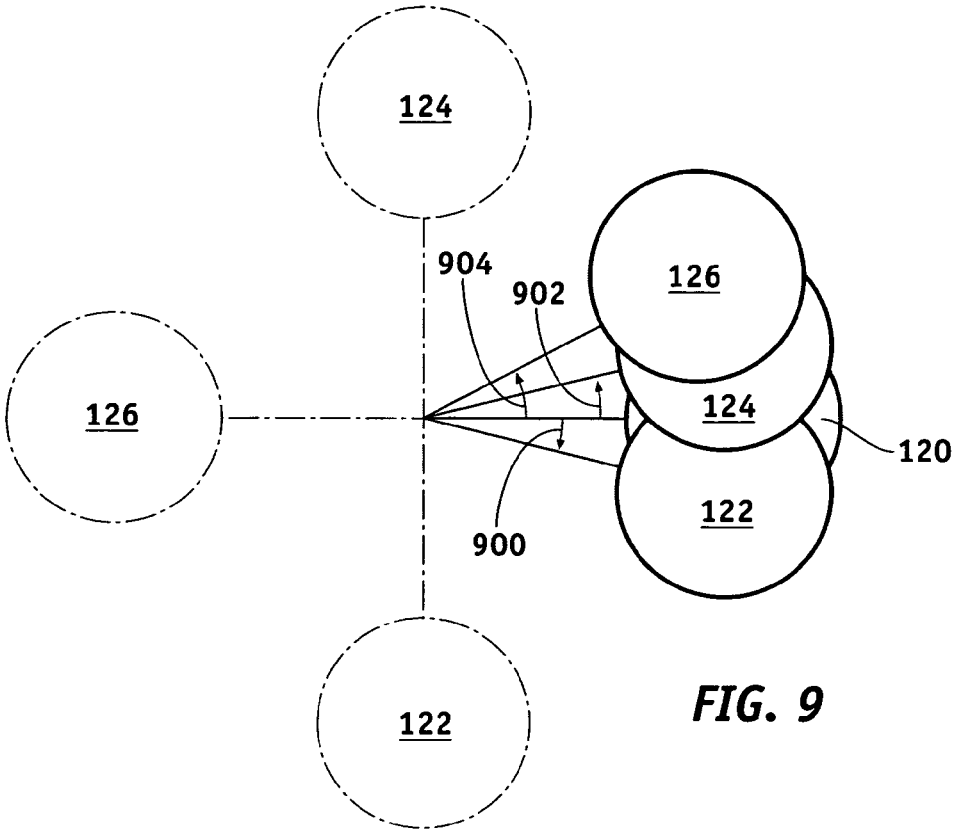
FIGS. 9 and 10 are plan-view diagrams illustrating the facet array in partial and complete fan-out configurations, respectively.
Figure 10:
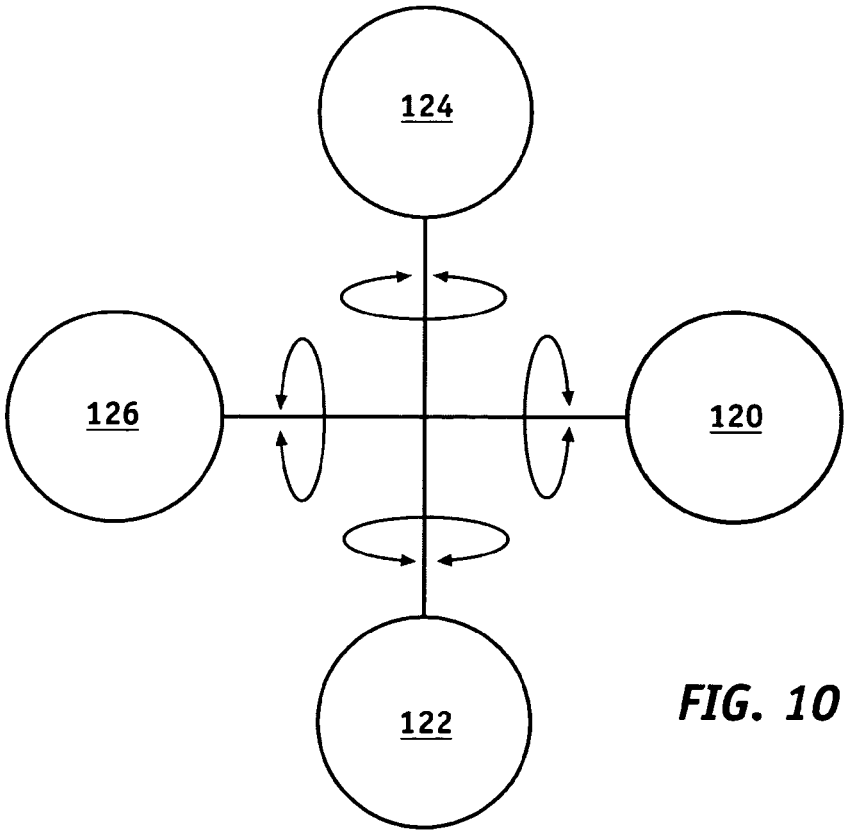

Next, as illustrated in FIG. 5D, telescopic facet stems 140, 142, 144, and 146 translate (telescope) longitudinally outward from facet stem hub assembly 150, thus moving respective facets 120, 122, 124, and 126 (still in a stacked configuration) away from facet stem hub assembly 150. The facet array may then begin to angularly disperse (i.e. fan out) as illustrated in FIG. 5E. More specifically, cuffs 602, 604, and 606 (FIG. 3) may begin to rotate facets 142, 144, and 146, respectively, about facet stem hub assembly 150 towards their non-overlapping (i.e. deployed) positions. As illustrated by FIG. 9, facet 122 may begin to rotate, for example, in a clockwise direction as indicated by arrow 900, and facets 124 and 126 may begin to rotate in a counter-clockwise direction as indicated by arrows 902 and 904, respectively. This may continue until facets 122 and 124 each rotate 90 degrees and facet 126 rotates 180 around facet stem hub assembly 150. In this embodiment, facet 120 does not rotate as indicated in phantom in FIG. 9. Deployment is complete when the facets have fully angularly dispersed as illustrated in FIG. 5F, FIG. 9 in phantom and in FIG. 10. In the non-overlapping, angularly dispersed, deployed configuration, facet array 102 may direct electromagnetic radiation at collector 112 (FIGS. 1–3) to heat fluid contained within propellant tank 106.

After deployment, it may be desirable to adjust the position of facets 120, 122, 124, and 126 jointly or individually relative to spacecraft 100 in order to fine tune (i.e. fine focus) optical alignment. This may be accomplished by manipulating boom 130 via motorized rotatable joints 136 or 170, or facet stem hub assembly 150 via motorized rotatable joint 152. Additionally, as illustrated by the arrows in FIG. 10, facets 120, 122, 124, and 126 may be rotated with respect to the longitudinal axes of stems 140, 142, 144, and 146, respectively, via swivel motors 700, 702, 704, and 706 (FIG. 4), respectively. As they are generally used for fine tuning, swivel motors 700, 702, 704, and 706 (FIG. 4) may have a relatively limited range of motion (e.g. plus or minus two degrees).

It should be appreciated that, although the exemplary concentrator described above is configured to focus sunlight, the inventive electromagnetic concentrator may be used to concentrate any form of electromagnetic radiation; for example, radio waves, microwaves, etc. Also, if the electromagnetic concentrator is in fact employed to focus sunlight, it may be employed in conjunction with any type of solar thermal engine system (e.g. an electricity-producing solar dynamic power system). It should also be understood that the four-leaf clover (i.e. angularly dispersed) configuration of the exemplary embodiment only suggests one possible way in which the facet array may be arranged. The facet array may be configured in a number of different ways and comprise a larger or smaller number of facets provided that the facets are rotatably coupled to the facet stem hub assembly and may rotate from a substantially overlapping configuration to a substantially non-overlapping configuration. For example, the electromagnetic concentrator may comprise eight facets, of which seven are rotatably coupled to rotatable cuffs provided around the facet stem hub assembly. When deployed, the eight facets may form a single angularly dispersed circular array configuration. Alternatively, when deployed, the eight facets may form two concentric angularly dispersed circular rows, each comprising four facets.

Motorized rotatable joints, telescopic stems (including swivel motors), and rotatable cuffs may be configured to be actuated remotely via wireless signals (e.g. emitted by a satellite control bus located, for example, on spacecraft 100), or instead may be self-actuating. Deployment boom 130 may be configured to lock into its extended (i.e. deployed) configuration by employing as the rotatable joints latching joints configured for one-time actuation. For example, the motorized rotatable joints may comprise spring-loaded torsion joints wherein a spring is maintained in a compressed state by a paraffin actuator. After launch, the paraffin actuator may be heated by the sun and melt thereby permitting the compressed torsion spring to expand and rotate the joint.

While only the exemplary embodiment has been presented in the foregoing detailed description, it should be appreciated that a vast number of variations exist. It should also be appreciated that the exemplary embodiment is only an example, and is not intended to limit the scope, applicability, or configuration of the invention in any way. Rather, the foregoing detailed description will provide those skilled in the art with a convenient road map for implementing the exemplary embodiment. Various changes can be made in the function and arrangement of elements without departing from the scope of the invention as set forth in the appended claims and the legal equivalents thereof.

The invention claimed is:

1. A deployable electromagnetic concentrator, comprising:

a facet stem hub assembly comprising at least one rotatable segment;

a plurality of facet stems coupled to said facet stem hub assembly, at least one of said plurality of facet stems coupled to said at least one of rotatable segments;

a plurality of facets each one coupled to a different one of said plurality of facet stems for rotating said plurality of facets from a substantially overlapping configuration to a substantially non-overlapping configuration;

a first elongated deployment boom segment having a first end and a second end, said first end of said first segment being coupled to said facet stem hub assembly;

a first rotatable joint coupled to said second end of said first segment;

a second elongated deployment boom segment coupled to said rotatable joint; and a second rotatable joint disposed between said facet stem hub assembly and said first end of said first segment.

2. An electromagnetic concentrator according to claim 1 wherein said plurality of facets is configured to be substantially stacked when in said overlapping configuration.

3. An electromagnetic concentrator according to claim 2 wherein said plurality of facets is configured to be substantially angularly dispersed around said facet stem hub assembly when in said non-overlapping configuration.

4. An electromagnetic concentrator according to claim 3 wherein at least one of said plurality of facet stems is configured for telescopic movement.

5. An electromagnetic concentrator according to claim 4 wherein said plurality facet stems comprises N facets stem and no more than N−1 facet stems are each coupled to a different one of said plurality of rotatable segments.

6. An electromagnetic concentrator according to claim 5 wherein at least one of said plurality of facets stems is fixedly coupled to said facet stem hub assembly.

7. An electromagnetic concentrator according to claim 1 wherein said first and said second elongated segments are substantially parallel and adjacent when said plurality of facets is in said overlapping configuration.

8. An electromagnetic concentrator according to claim 1 wherein said first segment is substantially collinear with said facet stem hub assembly when said plurality of facets is in said overlapping configuration.

9. An electromagnetic concentrator according to claim 1 wherein each facet of said plurality of facets is angularly separated from adjacent facets by substantially 360/N degrees when said plurality of facets is in said non-overlapping configuration wherein N is the number of facets.

10. An electromagnetic concentrator according to claim 1 further comprising a first rotatable motor coupled to at least one of said plurality of facets for rotating said at least one of said plurality of facets about an axis substantially perpendicular to an axis of said facet stem hub assembly.

11. An electromagnetic concentrator according to claim 10 wherein each of said plurality of facets is substantially circular.

12. An electromagnetic concentrator according to claim 10 wherein said plurality of facets comprises four facets.

13. An electromagnetic concentrator according to claim 10 wherein said electromagnetic concentrator is a solar concentrator.

14. An electromagnetic concentrator according to claim 10 wherein at least one of said rotatable joints of said deployment boom comprises a spring.

15. An electromagnetic concentrator for use on a spacecraft having a radiation collector coupled thereto and having a deployment boom having a proximal end coupled to the spacecraft and having a distal end, the concentrator comprising:

a facet stem hub assembly coupled to the distal end of the deployment boom having a plurality of rotatable segments positioned for rotation about a common rotational axis;

a plurality of facet stems coupled to said facet stem hub assembly, at least one of said plurality of facet stems coupled to at least one of said plurality rotatable segments; and a plurality of facets, each one of said plurality of facets being coupled to a different one of said plurality of facet stems, the plurality of facets configured to rotate from an overlapped configuration, wherein said plurality of facets is substantially stacked, to a non-overlapped configuration, wherein said plurality of facets is angularly dispersed around the common rotational axis of said facet stem hub assembly and wherein the plurality of facets is configured to concentrate radiation into the radiation collector.

16. An electromagnetic concentrator according to claim 15 wherein at least one of said plurality of facet stems is configured for telescopic movement.

17. An electromagnetic concentrator according to claim 15 wherein said plurality of facet stems comprise N facet stems and no more than N−1 facet stems are each coupled to a different one of said plurality of rotatable segments.

18. An electromagnetic concentrator according to claim 17 wherein at least one of said plurality of facet stems is fixedly coupled to said facet stem hub assembly.

19. An electromagnetic concentrator according to claim 17 wherein said deployment boom further comprises:

a first elongated segment having a distal end and a proximal end, said distal end of said first segment coupled to said facet stem hub assembly;

a first rotatable joint coupled to said proximal end of said first segment, and a second elongated segment having a distal end and a proximal end, said second segment coupled to said rotatable joint at said distal end and to said spacecraft at said proximal end.

20. An electromagnetic concentrator according to claim 19 wherein said first and said second elongated segments are substantially parallel and adjacent when said plurality of facets is in said overlapping configuration.

21. An electromagnetic concentrator according to claim 20 wherein said deployable electromagnetic concentrator further comprises a second rotatable joint disposed between said facet stem hub assembly and said distal end of said first segment.

22. An electromagnetic concentrator according to claim 21 wherein said first segment is substantially collinear with said facet stem hub assembly when said plurality of facets is in said overlapping configuration.

23. An electromagnetic concentrator according to claim 22 wherein each facet of said plurality of facets is angularly displaced separated from adjacent facets by substantially 360/N degrees when said plurality of facet is in said non-overlapping configuration.

24. An electromagnetic concentrator according to claim 22 further comprising a first rotatable motor coupled to at least one of said plurality of facets for rotating said at least one of said plurality of facets about an axis substantially perpendicular to an axis of said facet stem hub assembly.

25. An electromagnetic concentrator according to claim 23 wherein each of said plurality of facets is substantially circular.

26. A spacecraft, comprising:

a payload;

a deployment boom, comprising:

a proximal rotatable joint coupled to said payload;

a first elongated segment having a distal end and a proximal end, said first segment coupled to said proximal rotatable joint at said proximal end;

an intermediate rotatable joint coupled to said distal end of said first elongated segment;

a second elongated segment having a distal end and a proximal end, said second segment coupled to said intermediate rotatable joint at said proximal end; and a distal rotatable joint coupled to said distal end of said second elongated segment;

an electromagnetic collector coupled to said payload; and an electromagnetic concentrator, comprising:

a facet stem hub assembly having a plurality of rotatable segments disposed substantially thereround, said hub assembly coupled to said distal end of said second elongated segment;

a plurality of telescopic facet stems coupled to said facet stem hub assembly, at least one of said plurality of telescopic facet stems coupled to at least one of said plurality rotatable segments; and a plurality of facets each one coupled to a different one of said plurality of telescopic facet stems and configured to rotate from an overlapped configuration, wherein said plurality of facets is substantially stacked and wherein said first segment and said second segment of said deployment boom are substantially parallel and adjacent, to a non-overlapped configuration, wherein said plurality of facets is angularly dispersed around said facet stem hub assembly and configured to substantially concentrate radiation into the radiation collector.

27. A spacecraft according to claim 26 further comprising a launch vehicle having a stowage compartment therein, said stowage compartment configured to substantially receive said payload, said deployment boom, said electromagnetic collector, and said electromagnetic concentrator.

28. A spacecraft according to claim 27 wherein said electromagnetic concentrator is in said overlapped configuration when stowed within said stowage compartment.

29. A spacecraft according to claim 28 wherein said stowage compartment is substantially cylindrical.

30. A spacecraft according to claim 29 wherein each of said plurality of facets is substantially circular.

31. A method for deploying an electromagnetic concentrator in an overlapping configuration, the electromagnetic concentrator being coupled by way of a deployment boom to a spacecraft having an electromagnetic collector and comprising a facet stem hub assembly having N facet stems coupled thereto, the facet stem hub assembly comprising multiple rotatable segments aligned along a common rotational axis, each one being coupled to no more than N−1 of the N facets stems, N facet stems each further being coupled to a different one of a plurality of stacked facets, the method comprising:

extending the deployment boom from the spacecraft; and angularly dispersing the plurality of facets around the common rotational axis of the facet stem hub assembly by rotating at least one of the rotatable segments around the common rotational axis.

32. A method according to claim 31 further comprising the step of telescoping at least one of N facet stems to move at least one facet away from the facet stem hub assembly.

33. A method according to claim 31 further comprising the step of focusing electromagnetic radiation into the electromagnetic radiation collector.

34. A method according to claim 31 further comprising the step of rotating at least one facet about an axis substantially perpendicular to the common rotational axis of the facet stem hub assembly.

* * * * *